US009759089B2

(12) United States Patent
Weber et al.

(10) Patent No.: US 9,759,089 B2
(45) Date of Patent: Sep. 12, 2017

(54) TRANSPORTABLE MODULAR COATING SYSTEMS AND METHODS

(71) Applicant: General Electric Company, Schenectady, NY (US)

(72) Inventors: Markus Weber, Gosnells (AU); Joseph Garfield Albanese, Rotterdam Junction, NY (US); Michael Anthony DePalma, III, Simpsonville, SC (US); Patrick Thomas Walsh, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 793 days.

(21) Appl. No.: 14/101,797

(22) Filed: Dec. 10, 2013

(65) Prior Publication Data

US 2016/0160336 A1 Jun. 9, 2016

(51) Int. Cl.

| | |
|---|---|
| ***B05B 15/12*** | (2006.01) |
| ***B05B 3/00*** | (2006.01) |
| ***F01D 25/08*** | (2006.01) |
| ***C23C 4/12*** | (2016.01) |
| *F23R 3/00* | (2006.01) |

(52) U.S. Cl.

CPC ..... *F01D 25/08* (2013.01); *B05B 15/12* (2013.01); *B05B 15/1296* (2013.01); *C23C 4/12* (2013.01); *F23R 3/002* (2013.01)

(58) Field of Classification Search

USPC ..... 118/326, 309, 634, 50, 321, 323, 118/313–315

See application file for complete search history.

(56) References Cited

U.S. PATENT DOCUMENTS

| | | | | |
|---|---|---|---|---|
| 3,958,740 | A * | 5/1976 | Dixon | H01L 21/67144 118/238 |
| 4,532,886 | A | 8/1985 | Bouchard | |
| 4,562,791 | A * | 1/1986 | Porter | B05B 15/1229 118/326 |
| 4,872,419 | A | 10/1989 | Blankemeyer et al. | |
| 5,803,971 | A | 9/1998 | Menchetti et al. | |
| 5,853,215 | A | 12/1998 | Lowery | |
| 6,132,509 | A | 10/2000 | Kuschnereit | |
| 6,616,969 | B2 | 9/2003 | Pfaendtner et al. | |
| 7,975,935 | B2 | 7/2011 | Matheis, Jr. | |
| 8,033,244 | B2 * | 10/2011 | Minamida | H01L 21/67253 118/326 |
| 8,061,752 | B2 | 11/2011 | Ohnstad et al. | |

(Continued)

*Primary Examiner* — Yewebdar Tadesse

(74) *Attorney, Agent, or Firm* — Ernest G. Cusick; Frank A. Landgraff

(57) ABSTRACT

Transportable modular coating systems include a first transportable coating module comprising at least one first removable wall, a second transportable coating module comprising at least one second removable wall, wherein the first and second transportable coating modules are joinable when the first and second removable walls are removed, and a plurality of coating components fixed within the first and second transportable coating modules that combine to create a coating operation. The transportable coating module further includes a transportable control module that comprises a control system that operably connects to the plurality of coating components to operably control the coating operation.

10 Claims, 7 Drawing Sheets

(56) References Cited

U.S. PATENT DOCUMENTS

| | | | | |
|---|---|---|---|---|
| 8,500,838 | B2 * | 8/2013 | Pike | B01D 46/0013 55/385.1 |
| 2005/0184016 | A1 * | 8/2005 | Silverman | B05B 15/12 211/87.01 |
| 2009/0253360 | A1 | 10/2009 | Tafoya | |
| 2011/0166708 | A1 * | 7/2011 | Herre | B05B 13/0431 700/258 |
| 2011/0209321 | A1 | 9/2011 | Kilibarda et al. | |
| 2011/0256305 | A1 | 10/2011 | Jacques et al. | |
| 2013/0078385 | A1 * | 3/2013 | Hendricks, Sr. | B29D 30/0061 427/425 |
| 2013/0122206 | A1 | 5/2013 | Ahmed et al. | |

* cited by examiner

TRANSPORTABLE MODULAR COATING SYSTEMS AND METHODS

BACKGROUND OF THE INVENTION

The subject matter disclosed herein relates to coating components and, more specifically, to transportable modular coating systems and methods for coating turbine components.

In gas turbine engines, such as aircraft engines for example, air is drawn into the front of the engine, compressed by a shaft-mounted rotary-type compressor, and mixed with fuel. The mixture is burned, and the hot exhaust gases are passed through a turbine mounted on a shaft. The flow of gas turns the turbine, which turns the shaft and drives the compressor and fan. The hot exhaust gases flow from the back of the engine, driving it and the aircraft forward.

During operation of gas turbine engines, the temperatures of combustion gases may exceed 3,000° F., considerably higher than the melting temperatures of the metal parts of the engine which are in contact with these gases. Operation of these engines at gas temperatures that are above the metal part melting temperatures may depend in part one or more protective coatings and/or on supplying a cooling air to the outer surfaces of the metal parts through various methods. The metal parts of these engines that are particularly subject to high temperatures, and thus require particular attention with respect to cooling, are the metal parts forming combustors and parts located aft of the combustor.

For example metal temperatures can be maintained below melting levels by using one or more coatings, such as thermal barrier coatings (TBCs), applied via a coating process (e.g., a thermal spray process). However, the thermal spray process may require large rooms to hold all necessary thermal spray equipment and help contain the operation within a closed environment. This may be similarly true for other components such as generator features or other to-be-coated substrates. As a result, coating process may be performed in a finite number of locations using fixed equipment. This may also limit the ability to quickly and conveniently deploy coating cells to different facilities such that coatings can be applied to components such as turbine components in the field in a more standardized fashion.

Accordingly, alternative transportable modular coating systems and methods would be welcome in the art.

BRIEF DESCRIPTION OF THE INVENTION

In one embodiment, a transportable modular coating system is disclosed. The transportable modular coating system includes a first transportable coating module comprising at least one first removable wall, and, a second transportable coating module comprising at least one second removable wall, wherein the first and second transportable coating modules are joinable along the first and second removable walls such that the first and second transportable coating modules join to form a single coating cell when the first and second removable walls are removed. The transportable modular coating system further includes a plurality of coating components fixed within the first and second transportable coating modules that combine to create a coating operation when the first and second transportable coating modules are joined to form the single coating cell. The transportable coating module even further includes a transportable control module that comprises a control system that operably connects to the plurality of coating components to operably control the coating operation when the first and second transportable coating modules are joined together.

In another embodiment, a method for forming a transportable modular coating system is disclosed. The method includes providing one of a plurality of first transportable coating modules each comprising at least one first removable wall, wherein a same first portion of a plurality of coating components are fixed within each of the plurality of first transportable coating modules, and, providing one of a plurality of second transportable coating modules each of comprising at least one second removable wall, wherein each are individually joinable to any one of the plurality of first transportable coating modules along the first and second removable walls, and wherein a same second portion of the plurality of coating components are fixed within each of the plurality of second transportable coating modules. The method further includes removing the first and second removable walls from the provided first and second coating modules and joining the provided first and second coating modules to form a single coating cell, wherein the first and second portions of the plurality of coating components combine to create a coating operation. The method further includes providing one of a plurality of transportable control modules each comprising a control system, and, operably connecting the control system to the plurality of coating components to operably control the coating operation.

These and additional features provided by the embodiments discussed herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the inventions defined by the claims. The following detailed description of the illustrative embodiments can be understood when read in conjunction with the following drawings, where like structure is indicated with like reference numerals and in which:

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Transportable modular coating systems disclosed herein provide at least first and second transportable coating modules and a transportable control module to allow for a modular and transportable coating system that may provide greater flexibility in coating locations while promoting uniformity and consistency in coating operations. Each of the first and second transportable coating modules and the transportable control module are individually selected from a plurality of respective modules that can each comprise the same respective portion of coating components and potentially even be standardized in configurations or layouts. This may allow for a "plug and play" system where any one of the plurality of first transportable coating modules can be individually combined and joined with any one of the plurality of second transportable coating modules to form a coating operation, which, in turn, can further be connected to any one of the plurality of transportable control modules for control thereof. Thus, any three modules may be selected from their respective groups, shipped to a single site and combined together to form a coating operation. These and other features of the transportable modular coating systems and methods will be described in more detail herein.

Figure 1:
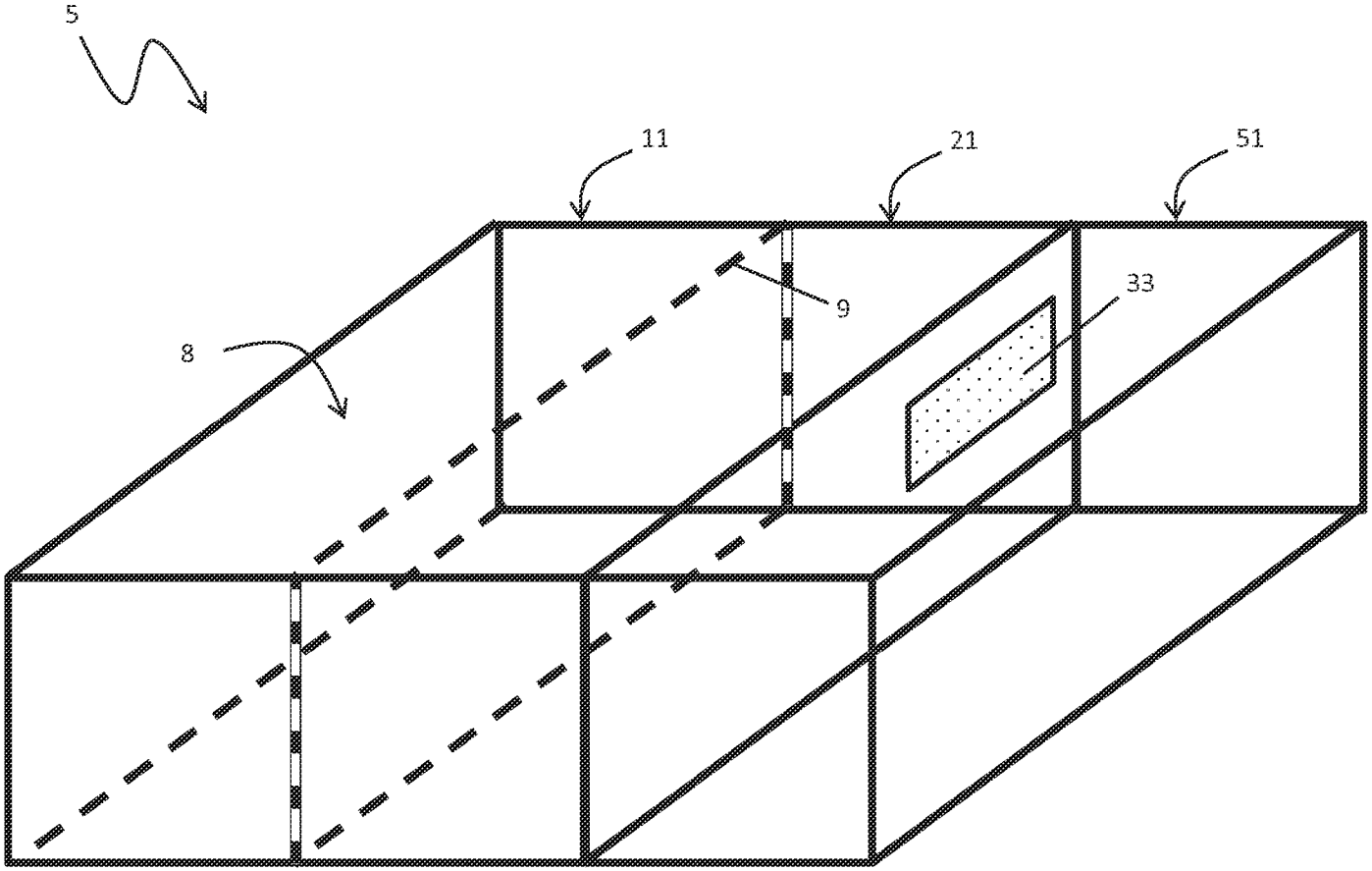
FIG. 1 is an external perspective view of a transportable coating module according to one or more embodiments shown or described herein.
Figure 2:
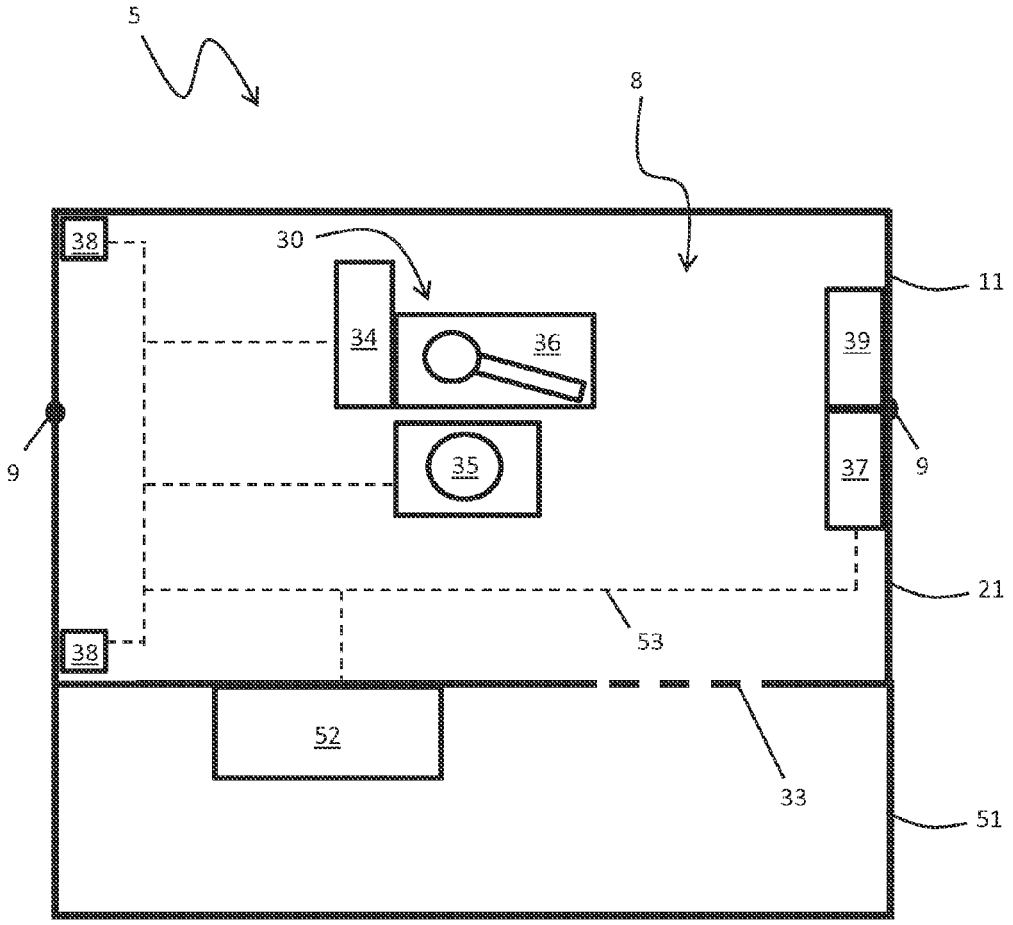
FIG. 2 is a top schematic view of an interior of the transportable modular coating system of FIG. 1 containing a plurality of coating components operably connected to a control system according to one or more embodiments shown or described herein.

Referring now to FIGS. 1 and 2, a transportable modular coating system 5 is illustrated. The transportable modular coating system 5 generally comprises a first transportable coating module 11, a second transportable coating module 21, a plurality of coating components 30 distributed between and fixed within the first transportable coating module 11 and the second transportable coating module 21, and a transportable control module 51 comprising a control system 52 that can operably connect with the plurality of coating components 30 to control a coating operation. Specifically, the first and second transportable coating module 11 and 21 can be joined to form a single coating cell 8 containing the plurality of coating components 30 which are thereby controlled by the control system 52 in the transportable control module 51.

Figure 3:
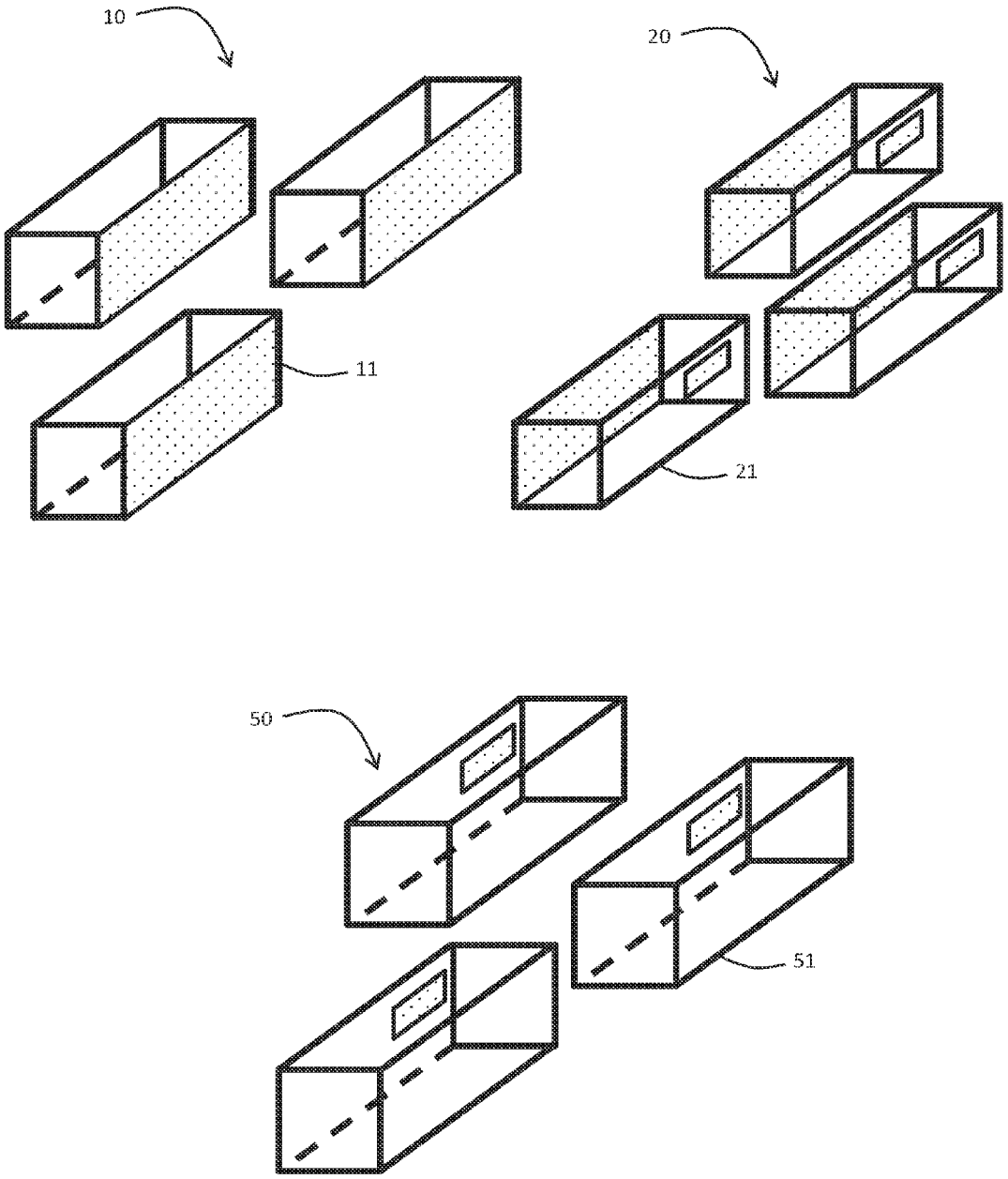
FIG. 3 illustrates of plurality of different sets of modules that can be independently utilized in a transportable coating module according to one or more embodiments shown or described herein.

Referring now additionally to FIG. 3, each of the transportable modules 11, 21 and 51 may be selected from a plurality of their own respective transportable coating modules 10, 20 and 50 as they each comprise the same respective internal components and layouts as every other module within its own group. That is, any one 11 of the plurality of first transportable coating modules 10 may be combined with any one 21 of the plurality of second transportable coating modules 20 to form the single coating cell 8 (comprising the plurality of coating components 30), which in turn can be combined with any one 51 of the plurality of transportable control modules 50 to form the same transportable modular coating system 5. As will become appreciated herein, the plurality of coating components 30 may be distributed between the first and second transportable coating modules 11 and 21 in a variety of configurations so long as each of the plurality of first transportable coating modules 10 comprises the same first portion of plurality of coating components 30 and each of the plurality of second transportable coating modules 20 comprises the same second portion of plurality of coating components 30. In some embodiments, each of the first portions of the plurality of coating components 30 may be fixed in each of the first transportable coating modules 10 in the same standardized first configuration or layout. Additionally or alternatively, in some embodiments each of the second portions of the plurality of coating components 30 may be fixed in each of the second transportable coating modules 20 in the same standardized second configuration or layout.

Referring now to FIGS. 1-5, each of the first transportable coating modules 11 generally comprises an enclosed and transportable structure with at least one first removable wall 12. For example, each of the first transportable coating modules 11 may comprise a standard commercialized shipping container design. "Standard commercialized shipping container design" as used herein refers to freight container designs (also called intermodal or shipping containers) whose dimensions are covered by ISO 6346. Such embodiments may ensure ease of transportation of the first transportable coating modules 11 by promoting convenient and commercially common shipping parameters to facilitate transportation using standard equipment (e.g., trucks, trains, boats, etc.). In some embodiments, each of the first transportable coating modules 11 may comprise any other standardized container such that all first transportable coating modules 11 comprise the same type of container.

Figure 4:
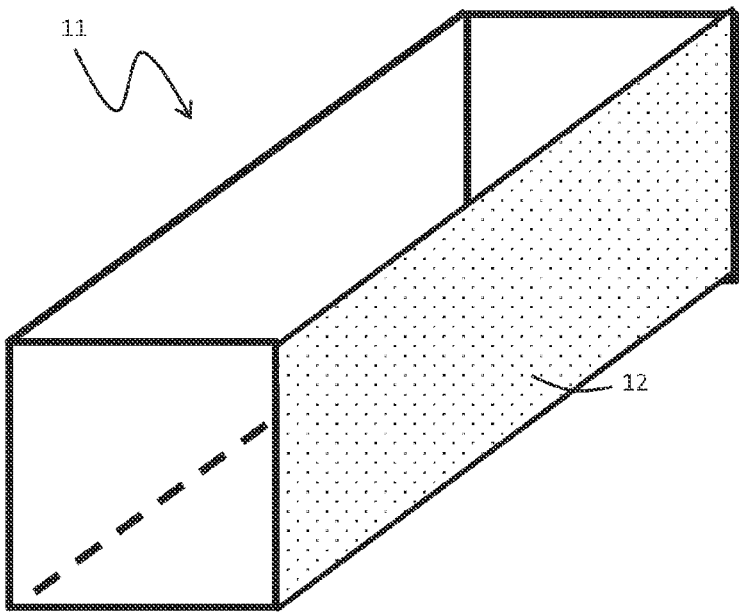
FIG. 4 is an external perspective view of a first transportable coating module according to one or more embodiments shown or described herein.
Figure 5:
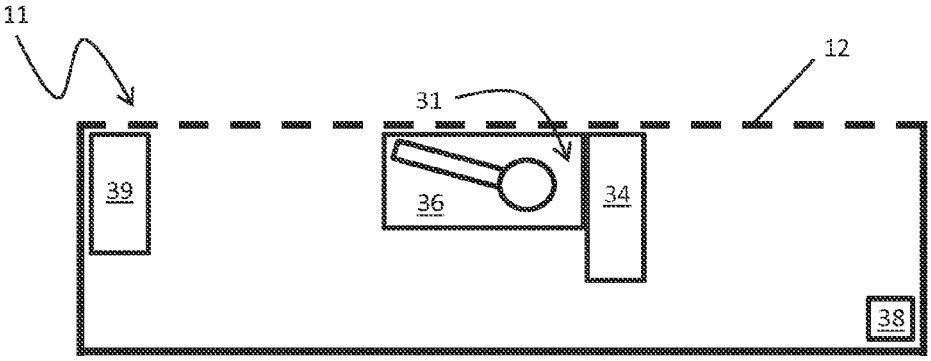
FIG. 5 is a top schematic view of an interior of the first transportable coating module of FIG. 4 containing a first portion of a plurality of coating components according to one or more embodiments shown or described herein.

As best illustrated in FIGS. 4 and 5, each of the first transportable coating modules 11 comprises a first removable wall 12. The first removable wall 12 comprises any wall that both remains in place during transportation (so as to protect the contents of the first transportable coating module 11 in a closed environment during transportation) and can be removed when at a coating location so that the first transportable coating module 11 may join with an adjacent second transportable coating module 21 with its second removable wall 22 removed to form a single coating cell 8 as illustrated in FIGS. 1 and 2.

For example, in some embodiments the first removable wall 12 may comprise the long side wall as illustrated in FIGS. 4 and 5. The first removable wall 12 may also be removable through any suitable fashion such as through latches, clamps, locks or the like. In some embodiments, the entire wall may be removable. In other embodiments, a substantial majority may be removable so long as the single coating cell 8 provides open access between the first and second transportable coating modules 11 and 21 to enable a coating operation as should be appreciated herein.

Each of the first transportable coating modules 11 comprises a first portion 31 of a plurality of coating components 30. The plurality of coating components 30 are those components required for a coating operation (e.g., the necessary components to coat a turbine component, generator features or other substrates as should be appreciated herein). The plurality of coating components 30 may thereby be divided into a first portion 31 and a second portion 32 that are fixed within the each of the first transportable coating modules 11 and second transportable coating modules 21 respectively. By providing the same first portion 31 to each of the first transportable coating modules 11, each of said first transportable coating modules 11 may be swapped in and out when forming a given single coating cell 8 for the transportable modular coating system 5.

Referring now to FIGS. 1-3 and 6-7, each of the second transportable coating modules 21 similarly generally comprises an enclosed and transportable structure with at least one second removable wall 22. For example, each of the second transportable coating modules 21 may comprise a standard commercialized shipping container design as discussed above. In some embodiments, the first and second transportable coating modules 11 and 21 may each comprise the same outer dimensions (e.g., the same standard commercialized shipping container design). Such embodiments may ensure ease of transportation of both the first and second transportable coating modules 11 and 21 by promoting convenient and commercially common shipping parameters to facilitate transportation using standard equipment (e.g., trucks, trains, boats, etc.). In some embodiments, each of the second transportable coating modules 21 may comprise any other standardized container such that all second transportable coating modules 21 comprise the same type of container.

Figure 6:
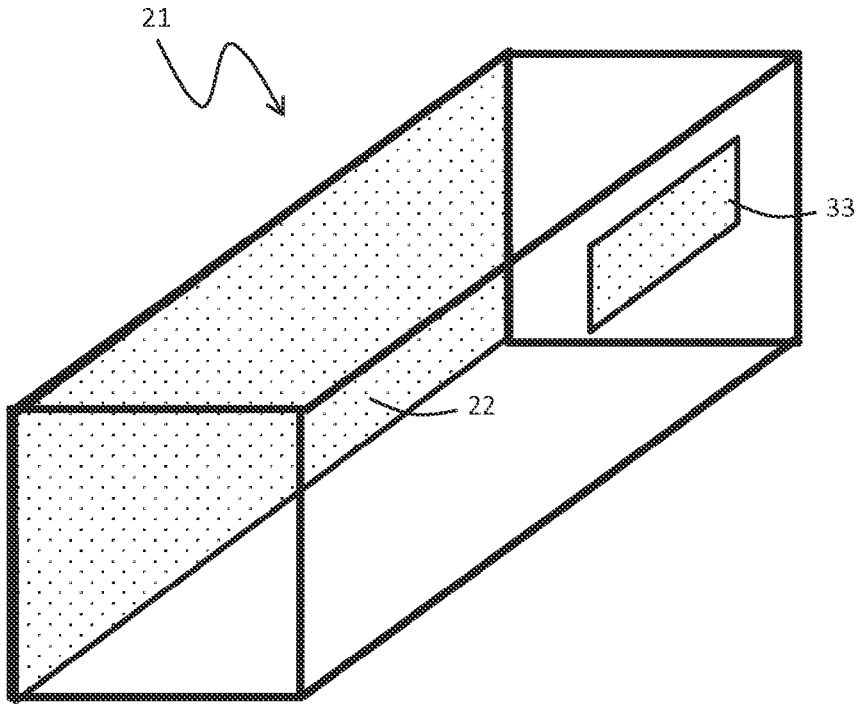
FIG. 6 is an external perspective view of a second transportable coating module according to one or more embodiments shown or described herein.
Figure 7:
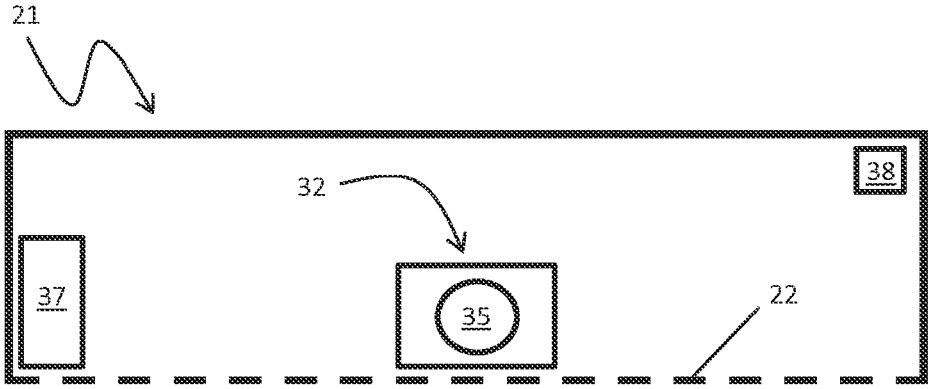
FIG. 7 is top schematic view of an interior of the second transportable coating module of FIG. 6 containing a second portion of a plurality of coating components according to one or more embodiments shown or described herein.
Figure 8:
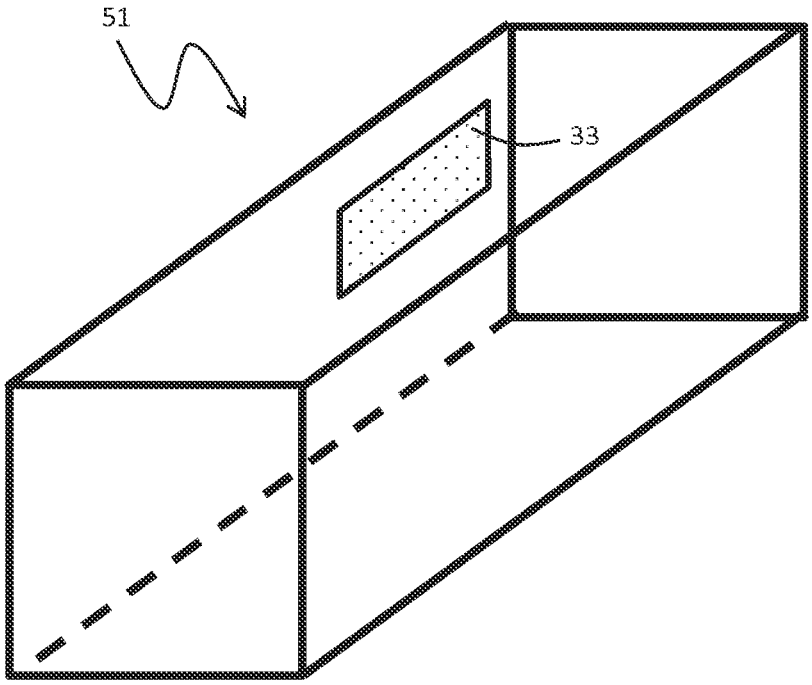
FIG. 8 is an external perspective view of a transportable control module according to one or more embodiments shown or described herein.
Figure 9:
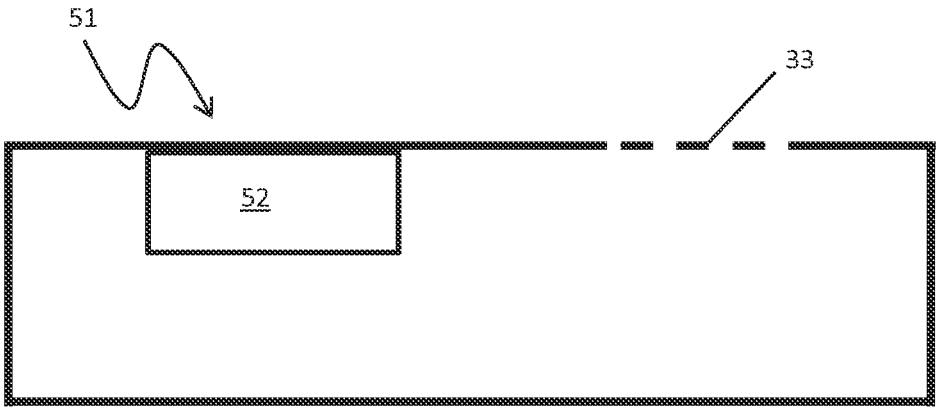
FIG. 9 is top schematic view of an interior of the transportable control module of FIG. 8 containing a control system according to one or more embodiments shown or described herein.

As best illustrated in FIGS. 6 and 7, each of the second transportable coating modules 21 comprises a second removable wall 22 similar to the first removable wall 12 of the first transportable coating module 11. The second removable wall 22 also comprises any wall that both remains in place during transportation (so as to protect the contents of the second transportable coating module 21 in a closed environment during transportation) and can be removed when at a coating location so that the second transportable coating module 21 may join with an adjacent first transportable coating module 11 with its first removable wall 12 removed to form a single coating cell 8 as illustrated in FIGS. 1 and 2.

For example, in some embodiments the second removable wall 22 may comprise the long side wall as illustrated in FIGS. 6 and 7. The second removable wall 22 may also be removable through any suitable fashion such as through latches, clamps, locks or the like. In some embodiments, the entire wall may be removable. In other embodiments, a substantial majority may be removable so long as the single coating cell 8 provides open access between the first and second transportable coating modules 11 and 21 to enable a coating operation as should be appreciated herein.

As best illustrated in FIGS. 1 and 2, once the first and second removable walls are removed, the first and second transportable coating modules 11 and 21 may be joined together to form a single coating cell 8. The single coating cell 8 can comprise a single enclosed structure comprising the internal volume of both the first and second transportable coating modules 11 and 21. The first and second transportable coating modules 11 and 21 may be joined through any suitable connection such as one or more latches, clamps, locks or the like. In some embodiments, joining the first and second transportable coating modules 11 and 21 may comprise a seal 9 such as a hermetic seal. Such embodiments may assist in containing within the single coating cell 8 any potential overspray or debris produced during the coating operation. The single coating cell 8 may further comprise one or more access ways (e.g., doors, ports, etc.) that allow operators to enter and exit the single coating cell 8 such that when the access way is shut the single coating cell 8 is completely enclosed.

Each of the second transportable coating modules 21 comprises a second portion 32 of a plurality of coating components 30 as discussed above. The second portion 32 of the plurality of coating components 30 (i.e., the balance of the coating components 30 not accounted for in the first portion 31) may thereby be fixed within the each of the second transportable coating modules 21. By providing the same second portion 32 to each of the second transportable coating modules 21, each of said second transportable coating modules 21 may be swapped in and out when forming a given single coating cell 8 for the transportable modular coating system 5.

As best illustrated in FIGS. 2, 5 and 7, the plurality of coating components 30 (i.e., the combined first portion 31 and second portion 32) combine to create a coating operation. Specifically, the first portion 31 of the plurality of components 30 in the first transportable coating module 11 and the second portion 32 of the plurality of components 30 in the second transportable coating module 21 combine to provide the necessary elements to coat one or more components such as turbine components, generator features and/or other substrates.

The plurality of components 30 may, for example, include coating spray equipment 34 and a component stand 35. The coating spray equipment 34 comprises the main spray components required to produce a coating spray as should be appreciated to those skilled in the art. For example, the coating spray equipment 34 may generally comprise a HVOF system, plasma system, other thermal spray system or the like. The coating spray equipment 34 may facilitate any coating to be applied to a component. For example, the coating spray equipment 34 may facilitate the coating of a turbine component such as with a thermal barrier coating, bondcoat, environmental barrier coating, or the like. The component stand 35 comprises any stand that at least supports the component during the coating operation. For example, the component stand 35 may comprise a table with support features for handling one or more types of components (e.g., turbine components including buckets, blades, shrouds, nozzles, liners or any other turbine component that is coated), may comprise a rotatable turntable, or may comprise any other support structure that can hold one or more components during coating.

In some embodiments, such as that illustrated in FIGS. 2, 5 and 7, the coating spray equipment 34 and component stand 35 may be separately fixed within the first and second transportable coating modules 11 and 21 proximate their respective first and second removable walls 12 and 22. Such embodiments may provide the most amount of operating room for the crux of the coating operation by placing the main elements towards the middle of the single coating cell 8.

In some embodiments, the plurality of coating components 30 may further comprise a robotic system 36 that controls movement of at least one of the coating spray equipment 34 and the component stand 35. The robotic system 36 may comprise any robotic apparatus providing multiple degrees of freedom (e.g., 2, 3, 4, 5, 6, etc.) to rotate and move the coating spray equipment 34 (e.g., the spray gun or nozzle) and/or the component stand 35 (e.g., moving the component itself). The robotic system 36 may thereby facilitate the coating of the component by moving one or both elements to ensure uniform and/or complete coating coverage. For example, in some embodiments the robotic system 36 may comprise a commercially available Fanuc Robot System or the like.

Similar to the coating spray equipment 34 and the component stand 35, the robotic system may be fixed in one of the first or second transportable coating modules 11 and 21 proximate to their own first or second removable wall 12 and 22. Such embodiments may provide the robotic system 36 increased freedom in motion by placing it further from the walls of the single coating cell 8. Furthermore, in some embodiments, the plurality of coating components 30 may comprise multiple robotic systems 36, such as one for the coating spray equipment 34 and one for the component stand 35.

In some embodiments, the plurality of coating components 30 may further comprise a gas leak detection system 37. The gas leak detection system 37 may comprise one or more sensors disposed in one or both of the first and second transportable coating modules 11 and 21 to detect gas leaks from the coating operations (e.g., oxygen, hydrogen, etc.). In even some embodiments, a sensor of the gas leak detection system 37 may be disposed within the transportable control module 51.

In even some embodiments, the plurality of coating components 30 may comprise one or more additional auxiliary components 39. The one or more auxiliary components 39 may comprise any other elements that may be utilized before, during or after the coating operation or otherwise help facilitate the process. For the example, the one or more additional auxiliary components 39 may comprise power supplies, fuses or other electrical junctions to help distribute and manage power within the transportable modular coating system 5. Alternatively or additionally, the one or more additional auxiliary components 39 may comprise one or more plenums to contain one or more gasses for the coating operation. In even some embodiments, the one or more auxiliary components 39 may comprise a storage unit for housing service tools and/or replacements parts that may be used to help maintain the other plurality of coating components 30. It should be appreciated that the one or more auxiliary components 39 may thereby comprise any further components that may help facilitate the coating operation.

While specific components have been presented herein, and discussed with respect to particular locations within the single coating cell 8, it should be appreciated that these specific embodiments are exemplary and non-limiting. The plurality of coating components 30 may comprise additional and/or alternative components that may be placed in the same of different configurations as long as the same first portion 31 and the same second portion 32 are used in each of the first and second transportable coating modules 11 and 21 respectively to facilitate the same, transportable modular coating system 5 on deployment.

Referring now to FIGS. 1-3 and 8-9, the transportable modular coating system 5 further comprises the transportable control module 51 that comprises a control system 52 that can operably connect with the plurality of coating components 30 to control the coating operation. In some embodiments, the transportable control module 51 may also visually gain access to the single coating cell.

For example, each of the transportable coating modules 51 may comprise a standard commercialized shipping container design as discussed above. In some embodiments, transportable control module 51 may comprise the same outer dimensions (e.g., the same standard commercialized shipping container design) as one of or both of the first and second transportable coating modules 11 and 21. Such embodiments may ensure ease of transportation of each module (i.e., both the first and second transportable coating modules 11 and 21 and the transportable control module 51) by promoting convenient and commercially common shipping parameters to facilitate transportation using standard equipment (e.g., trucks, trains, boats, etc.). In some embodiments, each of the transportable control modules 51 may comprise any other standardized container such that all transportable control modules 51 comprise the same type of container.

In some embodiments, the transportable control module 51 may gain visual access to the single coating cell 8 through a variety of mechanisms. As used herein, "visual access" refers to being able to visually observe the coating operation within the single coating cell 8 from the transportable control module 51. In some embodiments, the transportable control module 51 and or both of the first and second transportable coating modules 11 and 21 can comprise one or more windows 33 that align with one another when all modules 11, 21 and 51 are joined together. In other embodiments, the one or both of the first and second transportable coating modules 11 and 21 can comprise one or more cameras 38 that are linked to the control system 52 (e.g., via monitors) in the transportable control module 51.

The transportable control module 51 further comprises the control system 52 that can operably connect to the plurality of coating components 30 to operably control the coating operation. The operable connection 53 may comprise any type of communication link that facilitates the monitoring, diagnostics and/or control of one or more of the plurality of coating components 30 to coat one or more components (e.g., turbine components). The control system 52 can thereby comprise any suitable system for controlling one or more of the coating components 30 such as one or more computers or the like.

In some embodiments, the transportable modular coating system 5 may further comprise a supplemental transportable coating module selected from a plurality of supplemental transportable coating modules. The supplemental transportable coating module may comprise the same shape and dimensions as the first and/or second transportable coating modules 11 and 21 such as the same standard commercialized shipping container designs. The supplemental transportable coating module may comprise one or more supplemental coating components for the coating operation and may itself be joinable to at least one of the first and second transportable coating modules 11 and 21.

For example, the one or more supplemental coating components may comprise a coating waste extraction system to remove waste coating from the single coating cell 8 during the coating operation. Such components may thereby include, for example, a vacuum system and piping to collect waste coating from the single coating cell 8 into a storage bin. Joining the supplemental transportable coating module may thereby comprise fluidly connecting the coating waste extraction system to the enclosed single coating cell 8.

In some embodiments, the supplemental transportable coating module may additionally or alternatively comprise any other supplemental coating components such as one or more of the auxiliary components 39 as discussed herein, or any other component needed to facilitate the coating operation within the single coating cell 8 (e.g., coating feedstock, gas supplies, power supplies, etc.).

Figure 10:
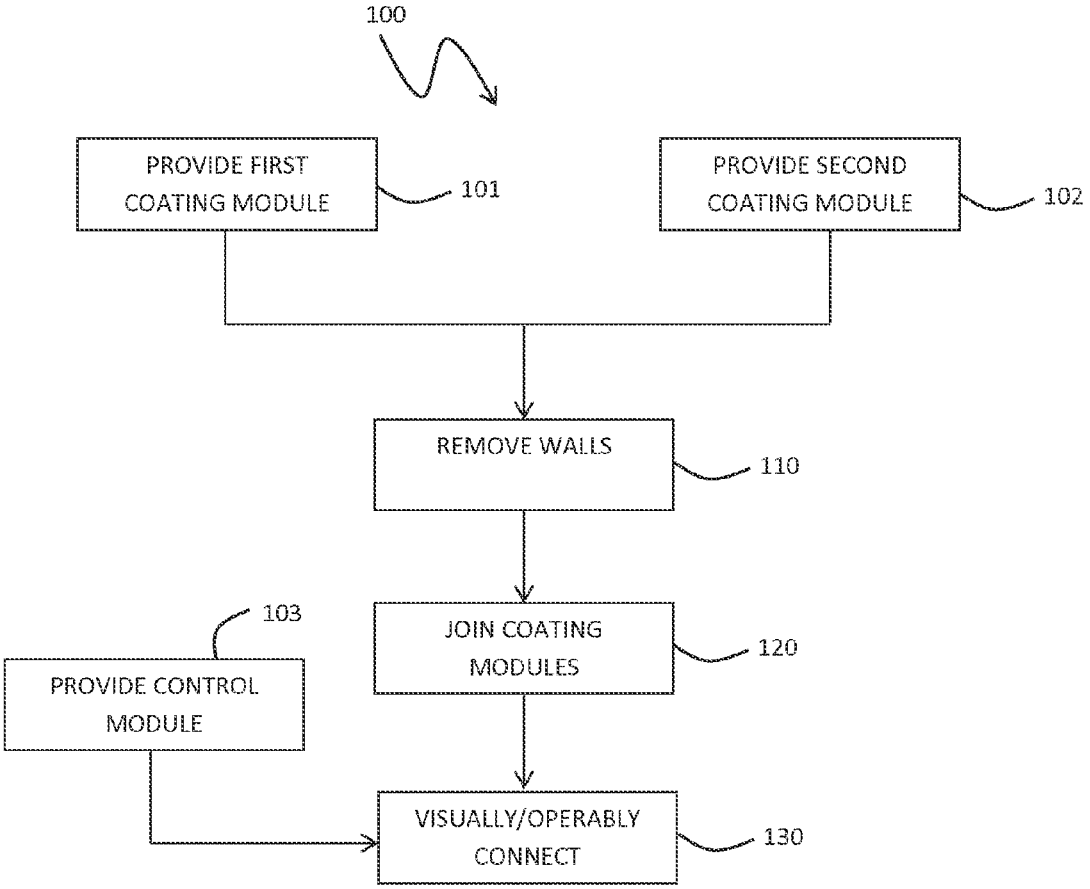
FIG. 10 is a method for forming a transportable modular coating system according to one or more embodiments shown or described herein.

Referring now additionally to FIG. 10, a method 100 is illustrated for forming a transportable modular coating system 5. The method 100 first comprises providing one 11 of a plurality of first transportable coating modules 10 in step 101 and providing one 21 of a plurality of second transportable coating modules 20 in step 102.

As discussed herein, each of the first transportable coating modules 11 comprise a first removable wall 12 and the same first portion 31 of a plurality of coating components 30 fixed therein. Likewise, each of the second transportable coating modules 21 comprise a second removable wall 22 and the same second portion 32 of the plurality of coating components 30 fixed. Each of the second transportable coating modules 21 is individually joinable to any one of the first transportable coating modules 11 along the first and second removable walls 12 and 22 respectively.

The method 100 further comprises removing the first and second removable walls 12 and 22 from the respectively provided first and second transportable coating modules 11 and 21 in step 110. The method 100 then further comprises joining the provided first and second coating modules 11 and 21 to form a single coating cell in step 120.

The method 100 further comprises providing one 51 of a plurality of transportable control modules 50 each comprising a control system 52 in step 103. Finally, but not necessarily as the last sequential step, the method 100 comprises operably connecting the control system 52 to the plurality of coating components 30 in step 130. In some embodiments, such as that illustrated in FIG. 10, step 130 may further comprise visually connecting the provided transportable control 51 module to the single coating cell 8 to gain visual access there between.

In some embodiments, providing the first transportable coating module 11 in step 101, the second transportable coating module 21 in step 102, and the transportable control module 51 in step 103 may comprise shipping said modules 11, 21 and 51 to a common location (e.g., service site).

In even some embodiments, the method 100 may further comprise providing one of a plurality of supplemental transportable coating modules, wherein each comprises one or more supplemental coating components for the coating operation as should be appreciated herein. In such embodiments, the method 100 may then comprise joining the provided supplemental transportable coating module to at least one of the first transportable coating module and the second transportable module.

It should be appreciated that while FIG. 10 illustrates steps 110, 120 and 130 occurring in this sequential order, steps 110, 120 and 130 may, in fact, occur in any relative order (or simultaneously) so long as the transportable modular coating system 5 is ultimately achieved. For example, step 120 may occur before or at the same time as step 110. Alternatively or additionally, step 130 may occur before, after or during either or both of steps 110 and 120.

It should now be appreciated that transportable modular coating systems may be provided by selecting any one of a plurality of first transportable coating modules, any one of a plurality of second transportable coating modules, and any one of a plurality of transportable control modules. Each of the plurality of modules can comprise similar (and potentially identical or standardized) features and layouts as every other module within its own group. Therefore, transportable modular coating systems may conveniently set up at a plurality of locations to provide multiple coating systems having more uniform components and layouts. Moreover, the near or complete standardization of each module within its own group can facilitate greater convenience and predictability by be able to swap a provided module with any other module from its own group.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A transportable modular coating system comprising:

a first transportable coating module comprising at least one first fully removable wall;

a second transportable coating module that is physically distinct from the first transportable coating module, the second transportable coating module comprising at least one second fully removable wall, wherein the first and second transportable coating modules are directly joinable to each other along the at least one first fully removable wall and the at least one second fully removable wall such that the first and second transportable coating modules join to form a single coating cell;

a plurality of coating components fixed within the first and second transportable coating modules that combine to create a coating operation, wherein the at least one first fully removable wall and the at least one second fully removable wall are removed prior to the coating operation; wherein the coating operation occurs within the first and second transportable coating modules; and, a transportable control module that comprises a control system that operably connects to the plurality of coating components to operably control the coating operation.

2. The transportable modular coating system of claim 1, wherein the plurality of coating components comprises coating spray equipment and a component stand.

3. The transportable modular coating system of claim 2, wherein the plurality of coating components further comprises a robotic system to control movement of at least one of the coating spray equipment and the component stand.

4. The transportable modular coating system of claim 2, wherein the plurality of coating components further comprises a gas leak detection system for detecting gas leaking from the single coating cell.

5. The transportable modular coating system of claim 1 further comprising a supplemental transportable coating module comprising one or more supplemental coating components for the coating operation, wherein the supplemental transportable coating module is joinable to at least one of the first transportable coating module and the second transportable coating module.

6. The transportable modular coating system of claim 5, wherein the one or more supplemental coating components comprises a coating waste extraction system to remove waste coating from the single coating cell.

7. The transportable modular coating system of claim 1, wherein the first and second transportable coating modules each comprise a standard commercialized shipping container design.

8. The transportable modular coating system of claim 7, wherein the transportable control module also comprises the standard commercialized shipping container design.

9. The transportable modular coating system of claim 1, wherein the transportable control module visually connects to at least one of the first and second transportable coating modules to gain visual access to the single coating cell.

10. The transportable modular coating system of claim 1, wherein the first and second transportable coating modules are joined into the single coating cell through a hermetic seal.

* * * * *